US009647391B2

(12) United States Patent
Sugimoto et al.

(10) Patent No.: US 9,647,391 B2
(45) Date of Patent: May 9, 2017

(54) CONNECTOR

(71) Applicant: Sumitomo Wiring Systems, Ltd., Yokkaichi, Mie (JP)

(72) Inventors: Shinpei Sugimoto, Mie (JP); Kenji Makino, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/063,607

(22) Filed: Mar. 8, 2016

(65) Prior Publication Data

US 2016/0294099 A1 Oct. 6, 2016

(30) Foreign Application Priority Data

Apr. 2, 2015 (JP) ..... 2015-075670

(51) Int. Cl.

| | |
|---|---|
| ***H01R 13/40*** | (2006.01) |
| ***H01R 13/642*** | (2006.01) |
| *H01R 13/422* | (2006.01) |
| *H01R 13/436* | (2006.01) |

(52) U.S. Cl.

CPC ..... *H01R 13/642* (2013.01); *H01R 13/4223* (2013.01); *H01R 13/4361* (2013.01)

(58) Field of Classification Search

CPC ..... H01R 13/4223; H01R 13/3695; H01R 13/514; H01R 103/00

USPC ..... 439/752.5, 595, 362–364, 594, 598, 733

See application file for complete search history.

(56) References Cited

U.S. PATENT DOCUMENTS 6,494,724 B1 * 12/2002 Bixler ..... H01R 13/506 439/79

FOREIGN PATENT DOCUMENTS

JP 2000-348807 12/2000

* cited by examiner

*Primary Examiner* — Phuongchi T Nguyen

(74) *Attorney, Agent, or Firm* — Gerald E. Hespos; Michael J. Porco; Matthew T. Hespos

(57) ABSTRACT

A lattice (29) is provided on a rear surface of a connector main body (10) and defines a plurality of insertion openings (28). The lattice (29) includes first and second walls (31, 32) extending parallel to each other in the same direction and third walls (33) intersecting the first and second walls (31, 32,). Rear ends of the first, second and third walls (31, 32, 33) are located more backward in the order of the second walls (32), the third walls (33) and the first walls (31). The first walls (31) provide identification from the surrounding by projecting more backward than the second walls (32). The third walls (33) achieve an improved resin flow by alleviating steps between the first and second walls (31, 32).

7 Claims, 5 Drawing Sheets

CONNECTOR

BACKGROUND

1. Field of the Invention

The invention relates to a connector.

2. Description of the Related Art

Japanese Unexamined Patent Publication No. 2000-348807 discloses a connector that has a housing with a number of cavities. Insertion openings are open at rear ends of the respective cavities on a rear surface of the housing. A terminal fitting is inserted into each cavity through the insertion opening from behind. A retainer is mounted into the housing obliquely from behind. The retainer is provided with marks for identifying the address of each insertion opening so that a predetermined terminal fitting can be inserted into the appropriate cavity without error using the mark as a guide.

Erroneous insertion of the terminal fittings can be prevented by providing marks on a part other than the retainer if the retainer cannot be mounted at a position corresponding to the respective insertion openings. Marks could be provided on an outer peripheral part of the rear surface of the housing. However, marks are difficult to see and a function as the marks cannot be sufficiently exhibited when the housing is reduced in size. In that respect, vertical or horizontal walls of a lattice may define each insertion opening and project more backward than the other walls to stand out on the rear surface of the housing. The projecting walls have identification power even if the housing is small. However, large steps may be formed between some walls and other walls, and the flow of resin is obstructed at steps when the resin flows in a molding space for the lattice wall during the molding of the housing. Thus, a molding failure may occur.

The invention was completed based on the above situation and aims to provide an easily moldable connector having a function of identifying insertion positions of terminal fittings.

SUMMARY

The invention is directed to a connector in which terminal fittings are inserted. The connector includes a connector main body with a rear surface that has insertion openings for receiving the terminal fittings. A lattice wall defining the insertion openings is provided on the rear surface of the connector main body. The lattice wall includes first walls and second walls extending parallel to each other in the same direction and third walls that intersect the first and second walls. The first, second and third walls are arranged with steps so that rear ends thereof are located more backward in the order of the second walls, the third walls and the first walls.

The first walls are seen to project conspicuously back when viewed with the second walls as a reference. Thus, predetermined terminal fittings can be inserted into each insertion opening without error using the first walls as marks. On the other hand, the steps between the first and second walls are alleviated by the third walls. Therefore, the lattice wall can be molded satisfactorily by causing resin to flow into parts corresponding to the third walls during molding.

An outer peripheral wall may be provided at an outer side of the lattice wall on the rear surface of the connector main body and may surround an outer periphery of the rear surface of the connector main body. A rear end of the outer peripheral wall is arranged at the same position as those of the first walls in a front-back direction or more backward than those of the first walls. According to this configuration, external matter will interfere with the outer peripheral wall, but not with the first walls.

An outer peripheral edge of the rear surface of the connector main body may be defined by two long side portions and two short side portions. The first walls may extend in a short side direction of the short side portions while being spaced apart in a long side direction of the long side portions. Identifying insertion openings becomes difficult if the number of the insertion openings arranged in the long side direction of the long side portions of the connector main body increases. However, the first walls divide the rear surface of the connector main body into plural blocks in the long side direction. Thus, the insertion openings can be identified easily block by block.

The same number and arrangement of the insertion openings are the same in each of at least two blocks divided by the first walls on the rear surface of the connector main body. According to this configuration, addresses for identifying the insertion openings in the blocks divided by the first walls are assigned more easily and identification is improved.

DETAILED DESCRIPTION

A first embodiment is described with reference to FIGS. 1 to 3. A connector according to this embodiment includes a connector main body 10 made of synthetic resin and terminal fittings 60 made of electrically conductive metal. Note that, in the following description, the concept of vertical and lateral directions is based on FIG. 1.

The connector main body 10 includes a housing 20 and a lever 40 to be mounted rotatably on the housing 20. The housing 20 is a generally rectangular block that is long in the lateral direction (width direction) and is connectable to an unillustrated mating housing from the front.

Figure 1:
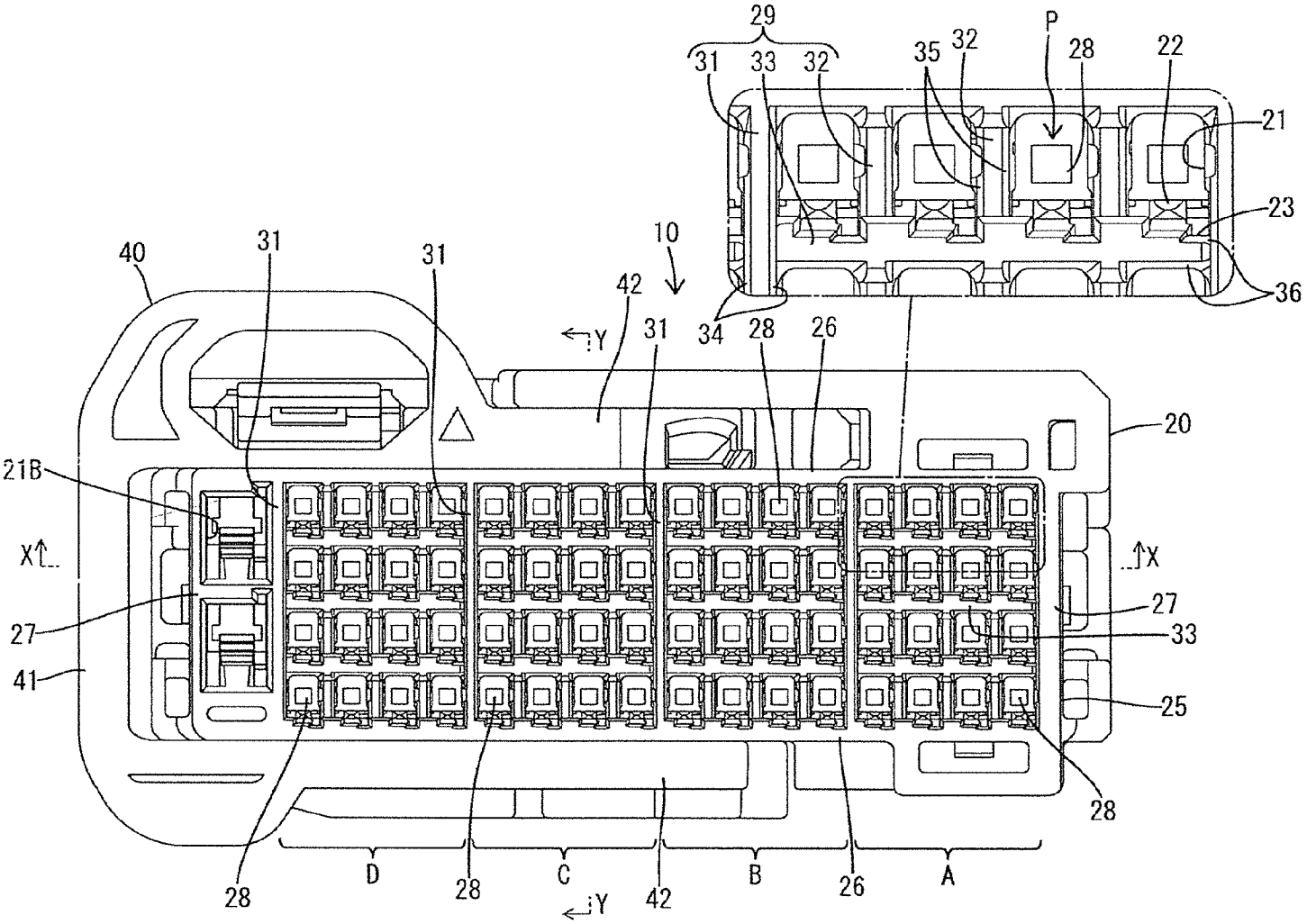
FIG. 1 is a rear view of a connector main body in a connector of a first embodiment of the present invention.

As shown in FIG. 1, the lever 40 is U-shaped and has a coupling portion 41 and two parallel cam portions 42 projecting from opposite end parts of the coupling portion 41. The lever 40 is mounted from the left to straddle the housing 20. The lever is rotated with the cam portions 42 of the lever 40 engaged with the mating housing. Thus, the mating housing is connected to the housing 20 with a low connection force.

Figure 2:
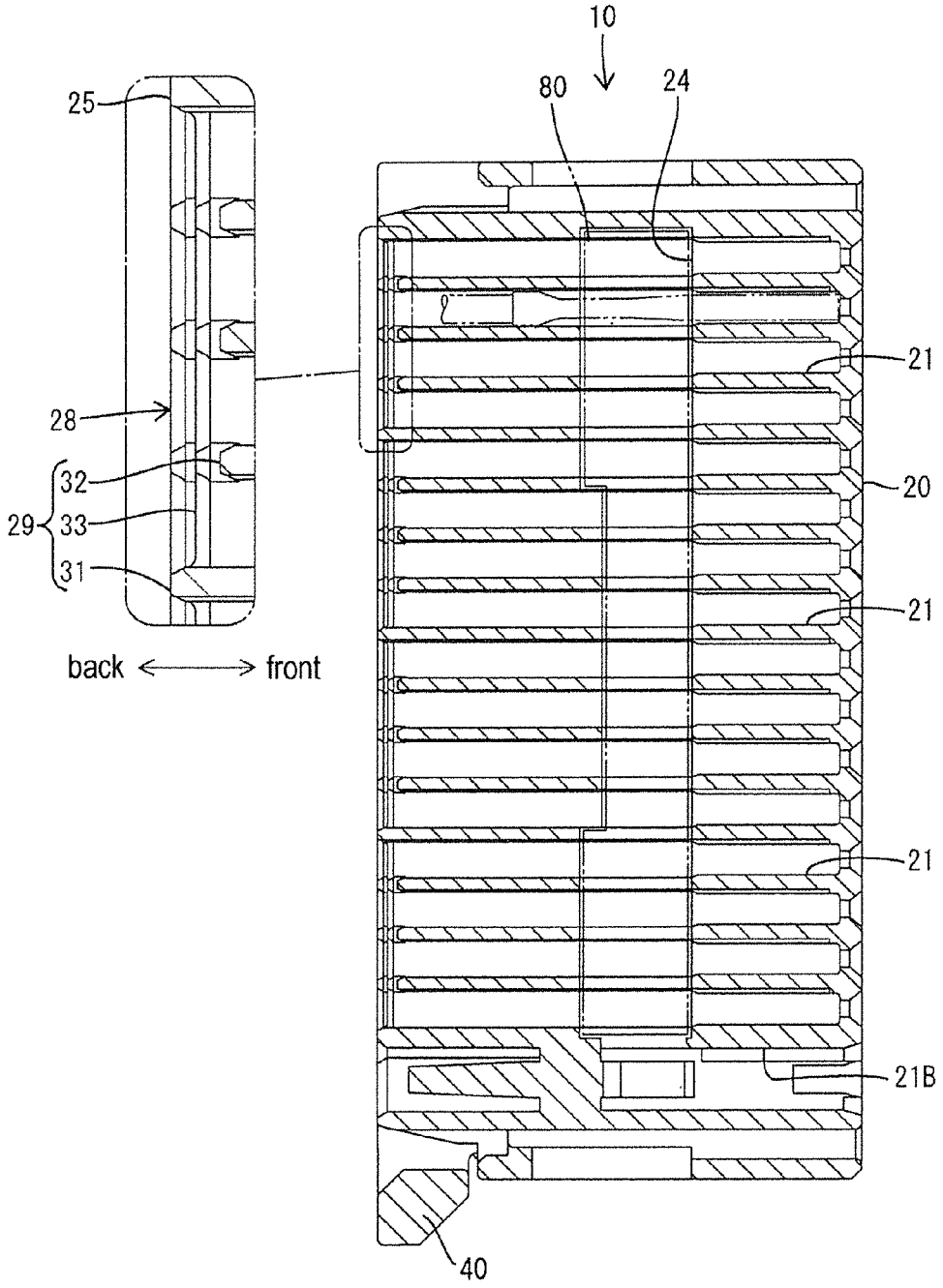
FIG. 2 is a section along X-X of FIG. 1.
Figure 3:
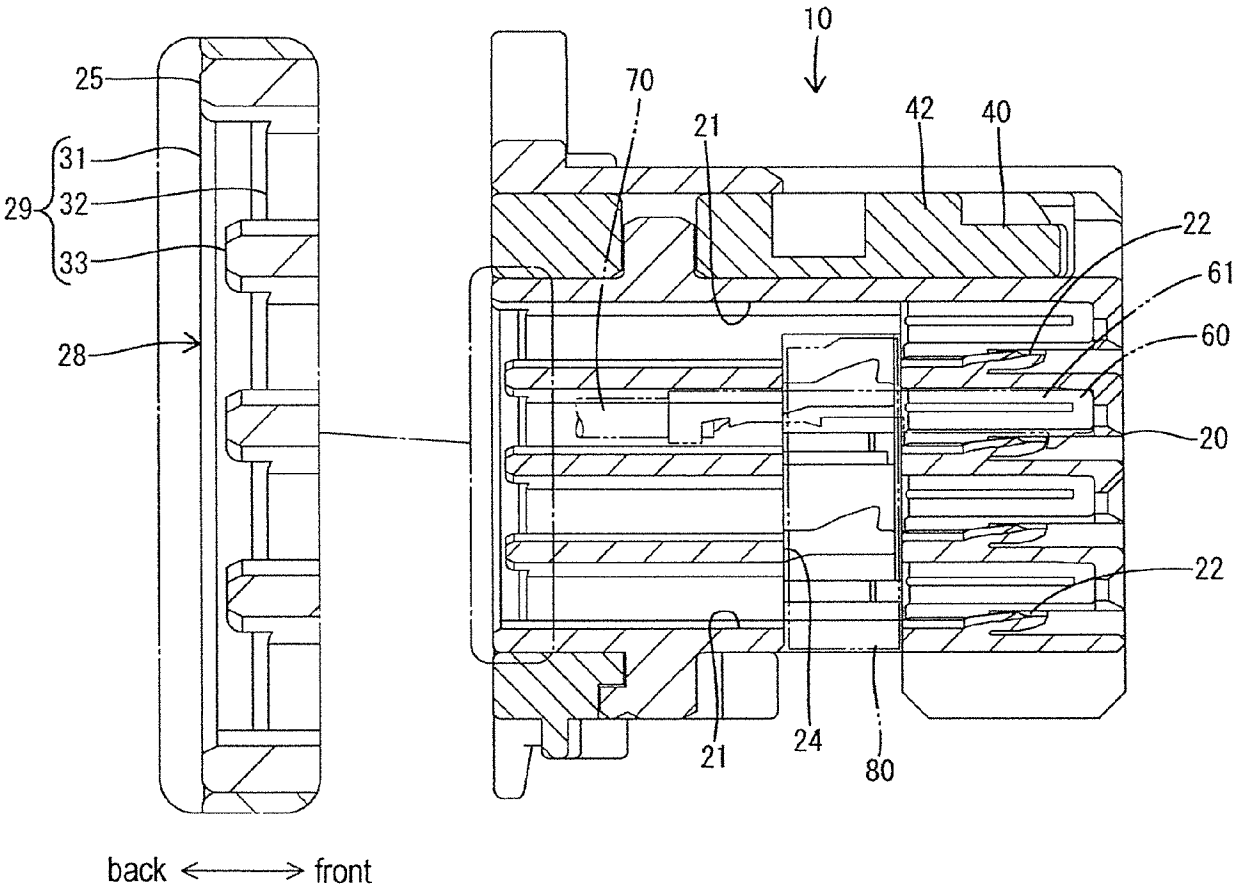
FIG. 3 is a section along Y-Y of FIG. 1.

As shown in FIGS. 2 and 3, cavities 21 extend in a front-back direction in the housing 20. As shown in FIG. 1, the cavities 21 include large cavities 21B in two upper and lower rows arranged on the left end and small cavities 21 aligned and arranged in the vertical and lateral directions except at the left end. In the following description, the cavities mean the small cavities 21 unless particularly specified.

As shown in FIG. 3, the terminal fitting 60 is inserted into the cavity 21 of the housing 20 from behind. The terminal fitting 60 is connected to an end part of a wire 70. A tubular box 61 is provided at a front part of the terminal fitting 60. The wire 70 is drawn out from an insertion opening 28 on the rear surface of the housing 20 when the terminal fitting 60 is inserted into the cavity 21. Further, when the two housings are connected properly, an unillustrated mating terminal fitting is inserted into the box 61 of the terminal fitting 60 to be connected electrically. A locking lance 22 projects in at the lower surface of the inner wall of the cavity 21. The locking lance 22 locks and retains the terminal fitting 60 properly inserted into the cavity 21.

As shown in FIG. 1, rearwardly open guiding grooves 23 communicate with rear end parts of the lower surfaces of the inner walls of the cavities 21 and extend in the front-back direction. An illustrated stabilizer of the terminal fitting 60 is inserted into the guiding groove 23 and guides an inserting movement of the terminal fitting 60. Further, as shown in FIGS. 2 and 3, a retainer insertion hole 24 is open on a side surface of the housing 20 and communicates with each cavity 21. The terminal fittings 60 are retained secondarily in the cavities 21 of the housing 20 by properly inserting a retainer 80 into the retainer insertion hole 24.

As shown in FIG. 1, the outer periphery of the rear surface of the housing 20 is configured by an outer peripheral wall 25 in the form of a rectangular frame long in the width direction in a rear view. An outer edge part of the outer peripheral wall 25 is defined by two long side portions 26 arranged substantially parallel to each other along the width direction and two short side portions 27 arranged substantially parallel to each other along the vertical direction (height direction). The cam portions 42 of the lever 40 are arranged along the long side portions 26 of the outer peripheral wall 25 and the coupling portion 41 of the lever 40 is arranged along the short side portion 27 of the outer peripheral wall 25.

As shown in FIG. 1, a number of insertion openings 28 are provided to be open inside the outer peripheral wall 25 on the rear surface of the housing 20 and define rear end openings of the respective cavities 21. Each insertion opening 28 is defined by a lattice 29 exposed on the rear surface of the housing 20.

As shown in FIG. 1, the lattice 29 is composed of a number of first and second walls 31, 32 arranged at intervals in the width direction, which is a long side direction of the long side portions 26, and a number of third walls 33 arranged at intervals in the vertical direction, which is a short side direction of the short side portions 27.

As shown in FIG. 1, four first walls 31 are arranged at fixed intervals in the width direction and extend straight in the vertical direction and both upper and lower ends thereof are integrally coupled substantially at a right angle to the long side portions 26 of the outer peripheral wall 25. The rear ends of the first walls 31 and those of the outer peripheral wall 25 are continuous and flush with each other at the same position in the front-back direction (see FIG. 2 in which a left side is a rear side and a right side is a front side). The large cavities 21B are defined between the first wall 31 on the left end and the short side portion 27 of the outer peripheral wall 25. Further, as shown in FIGS. 2 and 3, the rear ends of the first walls 31 are flat vertical surfaces and arranged at rearmost end positions of the connector main body 10 together with the outer peripheral wall 25. As shown in FIG. 1, both left and right sides of the rear end of the first wall 31 are chamfered to form tapered first chamfered portions 34.

Three second walls 32 are arranged at fixed intervals in the width direction between the first walls 31 adjacent in the width direction and extend straight in the vertical direction with upper and lower ends thereof coupled integrally substantially at a right angle to the long side portions 26 of the outer peripheral wall 25. Thus, the first and second walls 31, 32 are parallel to each other. As shown in FIGS. 2 and 3, the rear ends of the second walls 32 are flat vertical surfaces retracted forward from the rear ends of the first walls 31. As shown in FIG. 1, both left and right sides of the rear end of the second wall 32 are chamfered to form tapered second chamfers 35.

As shown in FIG. 1, three third walls 33 are arranged at fixed intervals in the vertical direction and extend straight in the width direction and both widthwise ends thereof are coupled integrally substantially at a right angle to the short side portion 27 on the right end and the first wall 31 on the left end. Further, the third wall 33 is coupled substantially at a right angle to the first and second walls 31, 32 at plural intermediate positions in an extending direction thereof. As shown in FIGS. 2 and 3, the rear ends of the third walls 33 are flat horizontal surfaces and are retracted forward from the rear ends of the first walls 31 and project backward from the rear ends of the second walls 32. As shown in FIG. 1, both upper and lower sides of the rear end of the third wall 33 are chamfered to form tapered third chamfers 36. Further, the upper edge of the third wall 33 defines the lower edges of the insertion openings 28 and descends in a stepped manner toward the guiding grooves 23.

If the rear ends of the second walls 32 serve as reference surfaces, a projecting distance of the third walls 33 from the reference surfaces in the front-back direction is shorter than that of the first walls 31 from the reference surfaces in the front-back direction. That is, the first to third walls 31, 32 and 33 are so configured that the projecting distances in the front-back direction become successively shorter in the order of the first walls 31, the third walls 33 and the second walls 32 to have three different projecting distances. Thus, when looking at the connector from behind, an operator can visually confirm a state where the first walls 31 are arranged to conspicuously project backward together with the outer peripheral wall 25 from the reference surfaces of the second walls 32 and can also confirm this state by touching with the hand.

As described above, a cavity area on the rear surface of the housing 20 is divided into four blocks (A to D to be described later) in the width direction by the four first walls 31 and the short side portion 27 on the right end. The same number (sixteen) of the insertion openings 28 are aligned in the same arrangement (four rows in the vertical direction and four columns in the width direction) inside each divided block.

As already described, the predetermined terminal fitting 60 is inserted into each cavity 21 through the insertion opening 28. In this first embodiment, to clarify into which insertion opening 28 the terminal fitting 60 is to be inserted, an address is given to each insertion opening 28. For example, if the four blocks are successively called A, B, C and D from the right end to the left end, the insertion openings 28 arranged in the width direction (column direction) are successively called 1, 2, 3 and 4 from the right end to the left end and the insertion openings 28 arranged in the vertical direction (row direction) are successively called I, II, III and IV from the top row to the bottom row, the insertion opening 28 indicated by an arrow P of FIG. 1 has an address of A2I. At this time, since the respective insertion openings 28 are arranged in the same manner in each block, the correspondence of 1 to 4 and I to IV is also the same. Thus, the operator can quickly perform an inserting operation by inserting the predetermined terminal fitting 60 into the insertion opening 28 of A2I without hesitation. Further, a situation where the terminal fitting 60 is erroneously inserted into the insertion opening 28 different from the intended one can be avoided.

The presence of large steps in the front-back direction between the first and second walls 31 and 32 can be confirmed visually or by touch when the rear ends of the first walls 31 are locked with the rear ends of the second walls 32 as the reference surfaces, the rear end positions of the first walls 31 serving as marks when the operator recognizes the blocks A to D are identified easily and good identifiability can be ensured.

On the other hand, if large steps are present between the first and second walls 31, 32, there is a concern that the flow of resin (molten resin) is deteriorated when the connector main body 10 is molded. However, according to this first embodiment, the third walls 33 having an intermediate height are so provided between the first and second walls 31, 32 to alleviate the steps between the first and second walls 31, 32 and the third walls 33 are coupled to the first and second walls 31, 32 and extend in the width direction. Thus, if the resin is caused to flow from right ends to left ends of the third walls 33 in a molding space of an unillustrated mold for molding the third walls 33, the resin smoothly flows also to the first and second walls 31, 32 via the third walls 33. Thus, the lattice 29 composed of the first, second and third walls 31, 32 and 33 is molded satisfactorily and an occurrence rate of defective products due to a molding failure can be suppressed low.

Figure 4:
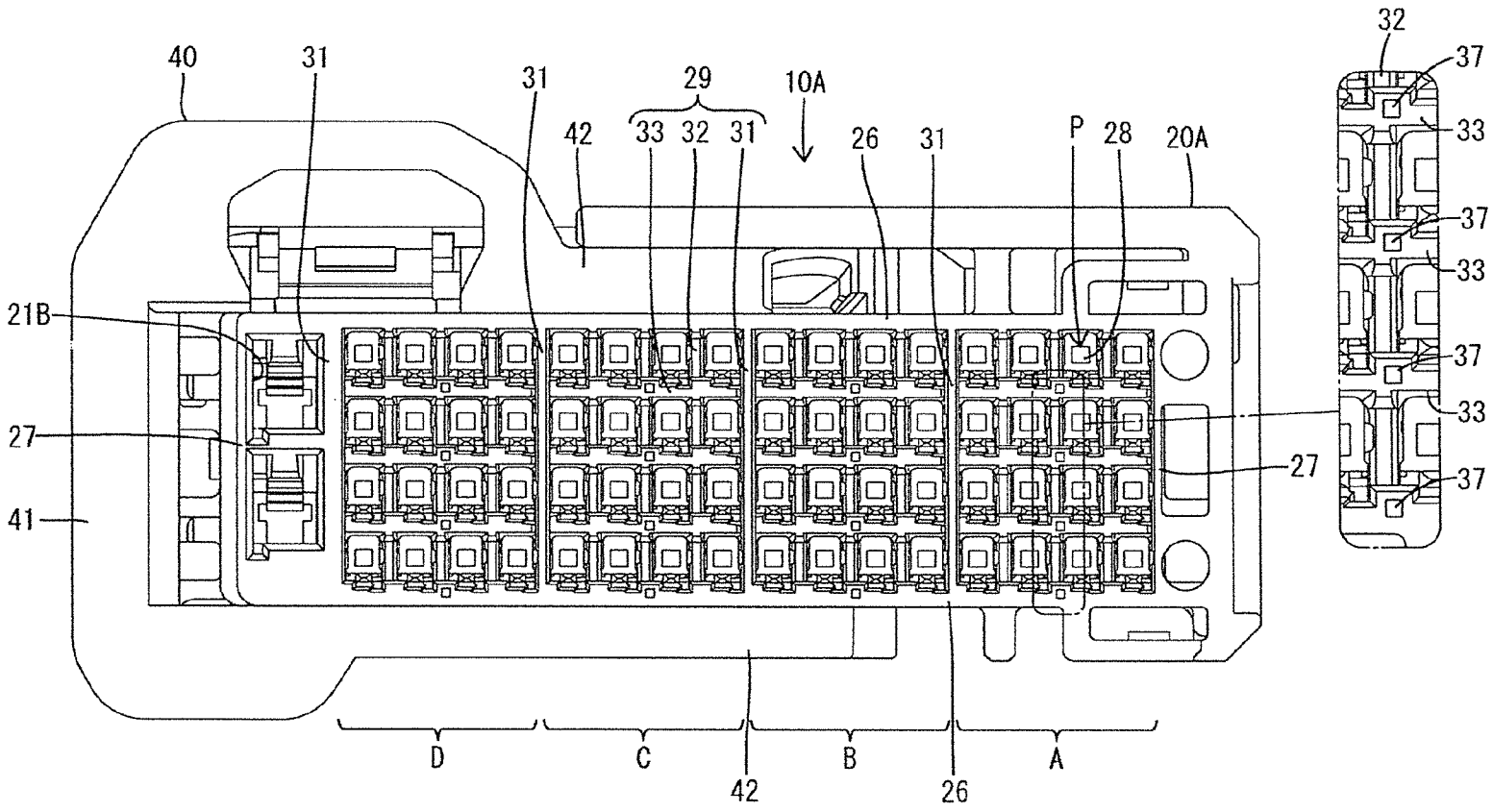
FIG. 4 is a rear view of a connector main body of a connector of a second embodiment.

A connector main body 10A of the second embodiment is illustrated in FIG. 4 and has identifiers 37 added to a lattice 29 similar to that of the first embodiment. The identifiers 37 define marks for more finely identifying the insides of blocks when inserting predetermined terminal fittings 60 into cavities 21 of a housing 20A through insertion openings 28.

The identifiers 37 are provided at the intersecting parts of the second walls 32 extending in a vertical direction and the third walls 33 in widthwise central parts of the blocks. The identifiers 37 are rectangular recesses open on the rear ends of the third walls 33 in a rear view. Of course, the identifiers 37 may be made identifiable from the surrounding by projections, color, pattern or the like and are not limited to recesses.

The identifiers 37 can be used auxiliarily for identifying the positions of the insertion openings 28. For example, in inserting a predetermined terminal fitting 60 into the insertion opening 28 of A2I indicated by an arrow P, the terminal fitting 60 can be inserted quickly and precisely with recognition that the insertion opening 28 of A2I is located to the right of and above the identifier 37 located in the top row of A.

Figure 5:
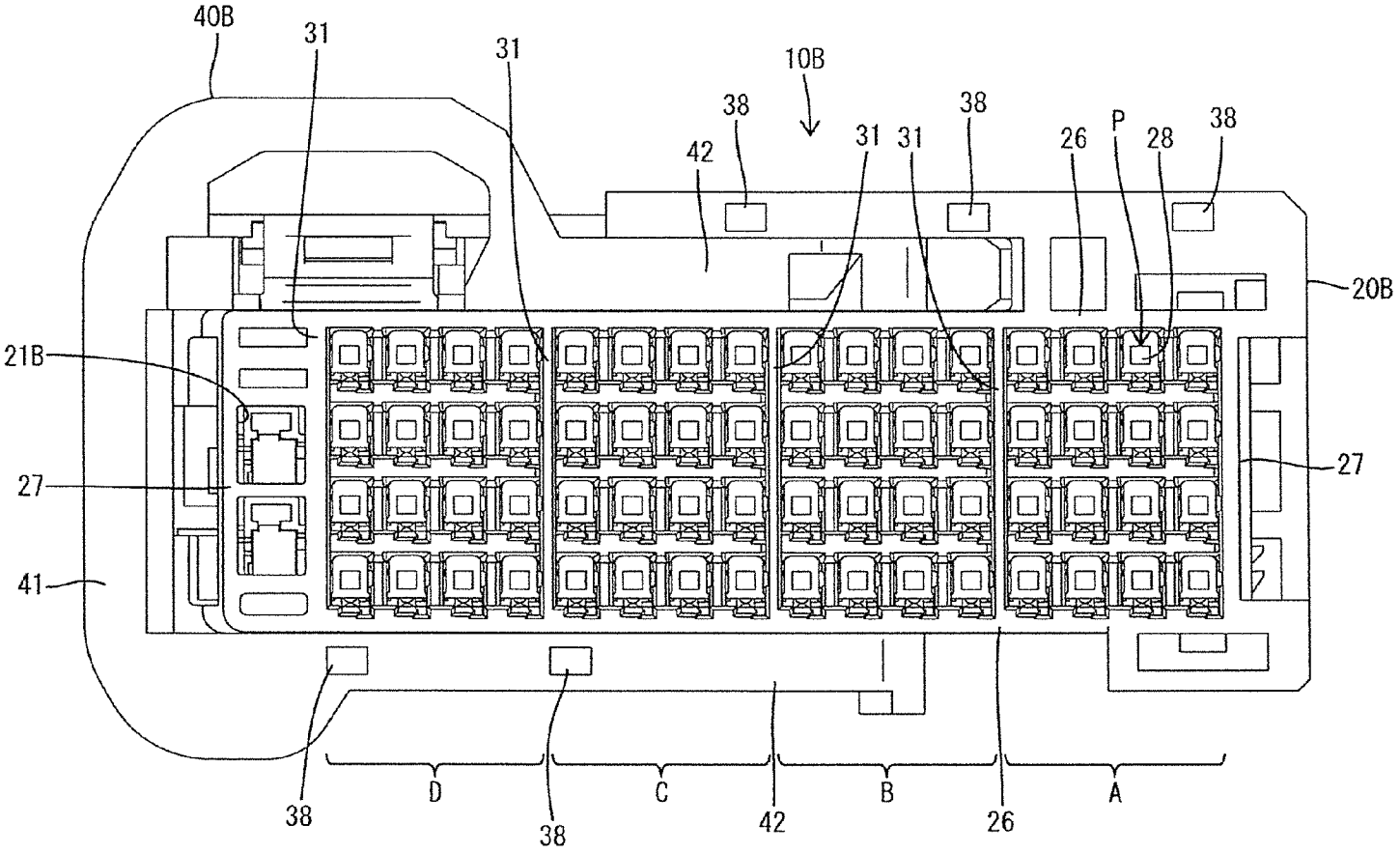
FIG. 5 is a rear view of a connector main body of a connector of a third embodiment.

FIG. 5 shows a third embodiment and has identifiers 38 added in parts serving as dead spaces of a connector main body 10B that is otherwise similar to the first embodiment. The identifiers 38 are provided on the rear end of a lower cam portion 42 of a lever 40B and on the rear end of an upper end part of a housing 20B. Although the identifiers 38 are formed as rectangular recesses open on the rear end of the lever 40B and the rear end of the housing 20B here, they are not limited to recesses if they are identifiable from the surrounding as in the second embodiment.

Two identifiers 38 of the lever 40B are provided at a predetermined interval in the width direction in a left lower part of the connector main body 10B and three identifiers 38 of the housing 20B are provided at predetermined intervals in the width direction in a right upper part of the connector main body 10B. Separating distances between the identifiers 38 adjacent in the width direction are equal. Thus, for example, an inserting operation of a predetermined terminal fitting 60 into an insertion opening 28 of A2I indicated by an arrow P can be performed, roughly guessing that the insertion opening 28 of A2I is located below and near the identifier 38 on the right end of the housing 20B, and the terminal fitting 60 can be inserted quickly and precisely. Further, the size and shape of the identifiers 38 of the third embodiment can be adjusted to be easily identifiable within permissible ranges of the dead spaces so that identification power can be improved further.

Other embodiments are briefly described below.

The first and second walls may extend in the width direction while being spaced apart in the vertical direction and the third walls may extend in the vertical direction while being spaced apart in the width direction. Such a mode is particularly effective for connectors with a connector main body long in the vertical direction.

The connector main body may be composed of a housing and a rear holder or a rear retainer and a lattice wall including first to third walls may be provided on the rear surface of the rear holder or on the rear surface of the rear retainer.

The rear end of the outer peripheral wall may be located more backward than the rear ends of the first walls.

Identifiers corresponding to those of the second embodiment may be provided on the first walls. The identifiers in this case function to enhance the identification power of the first walls by causing the presence of the first walls to stand out more.

The same number of insertion openings may be provided in the same arrangement in each of two blocks divided by a first wall.

LIST OF REFERENCE SIGNS

10, 10A, 10B . . . connector main body
20, 20A, 20B . . . housing
21 . . . cavity
25 . . . outer peripheral wall
28 . . . insertion opening
29 . . . lattice
31 . . . first wall
32 . . . second wall
33 . . . third wall
37, 38 . . . identifier
40, 40B . . . lever
60 . . . terminal fitting

What is claimed is:

1. A connector in which terminal fittings are inserted, the connector comprising:

a housing with opposite front and rear ends, first walls and second walls extending parallel to each other from the rear end toward the front end, third walls intersecting the first and second walls and extending from the rear end toward the front end, cavities extending through the housing from the rear end to the front end, the cavities having insertion openings at the rear end of the housing for insertion of the terminal fittings, the insertion opening of each of the cavities being defined by at least one of the first and second walls and at least one of the third walls, each of the first, second and third walls having a rear surface at the rear end of the housing, the rear surfaces of the first walls being more rearward than the rear surfaces of the second and third walls and the rear surfaces of the third walls being more rearward than the rear surfaces of the second walls.

2. The connector of claim 1, wherein the insertion openings are arranged in columns and rows to define a substantially rectangular array.

3. The connector of claim 1, wherein the housing has two opposed long sides and two opposed short sides, and the first walls extend parallel to the short sides.

4. The connector of claim 3, wherein equal numbers of the insertion openings are provided in identical arrangements in each of at least two blocks divided by the first walls on the rear end of the housing.

5. The connector of claim 1, further comprising an outer peripheral wall surrounding an outer periphery of the rear end of the housing at an outer side of the insertion openings, and a rear surface of the outer peripheral wall is aligned with or rearward of rear surfaces of the first walls in a front-back direction.

6. The connector of claim 5, wherein each of the first walls has opposite ends joined to the outer peripheral wall.

7. The connector of claim 5, wherein each of the third walls has at least one end joined to one of the first walls.

* * * * *